US006439735B1

(12) United States Patent
Shu

(10) Patent No.: US 6,439,735 B1
(45) Date of Patent: Aug. 27, 2002

(54) DOUBLE-TUBE WATER PEN

(76) Inventor: Ming-Tay Shu, PO Box 82-144, Taipei (TW)

( * ) Notice: Subject to any disclaimer, the term of this patent is extended or adjusted under 35 U.S.C. 154(b) by 0 days.

(21) Appl. No.: 09/755,141

(22) Filed: Jan. 8, 2001

(51) Int. Cl.[7] ..... B43K 29/10; F21V 9/12

(52) U.S. Cl. ..... 362/118; 362/101; 362/318; 362/806

(58) Field of Search ..... 362/118, 101, 362/318, 253, 806; 401/52, 192, 195, 141, 142; 40/334, 406

(56) References Cited

U.S. PATENT DOCUMENTS 5,735,592 A * 4/1998 Shu ..... 362/118
6,206,536 B1 * 3/2001 Lin ..... 362/101
6,238,057 B1 * 5/2001 Johnson ..... 362/101

* cited by examiner

*Primary Examiner*—Sandra O'Shea
*Assistant Examiner*—David V. Hobden
(74) *Attorney, Agent, or Firm*—Leong C. Lei

(57) ABSTRACT

This invention of double-tube water pen includes an outer tube, an inner tube, an ink tube, a pen cover, and a pen top. Once the inner and outer tubes are connected, decorative liquid can be added. The closed end of the inner tube can have an extended tube. This extended tube can take in ink tube in its outer tube and make the length of ink tube to be longer. Moreover, a glowing gadget can be installed into the empty space inside of inner tube. One end of the glowing gadget is pushed closely to the end of the ink tube. When users use the pen and press the ink tube to the glowing gadget, the glowing part inside of the gadget will receive current and start to glow. This will add special effect to the pen.

1 Claim, 10 Drawing Sheets

DOUBLE-TUBE WATER PEN

BACKGROUND OF THE INVENTION

In order to attract the interest of consumers, pen manufacturers have put much into research & development for the improvement in pen's appearance such as the shape and color. Manufacturers have modified pen's shape to meet the needs of consumers so that they can feel more comfortable while writing. Moreover, some manufacturers have added small cartoon characters on pens to make the appearance more attractive. Or some designs will install glowing parts to add special effects onto pens such as designs Ser. Nos. 09/172,627, 09/484,597 in the US market. The main purpose is to use these special designs in appearance or visual effect to attract the interest of consumers.

Because most consumers prefer new models and functions, manufacturers have to be very innovative. For this reason, the inventor of this invention has created a water pen with double tubes. The structure, function, effect and technology are listed as following.

SUMMARY OF THE INVENTION

This double-tube water pen includes a transparent or non-transparent outer tube, a transparent inner tube connected to the top of the outer tube, an inserted ink tube in the inner tube, a pen cover which is used to fix the ink tube connected to the top of the inner tube, and a pen top covering the top of the pen cover. Once the inner tube is connected with the outer tube, decorative liquid can be added into the space between the two tubes. This can improve the appearance and make it differ from traditional pens. Moreover, manufacturers can install an extended tube inside of the inner tube to take in the ink tube. This extended part is into the outer tube so that the length of the ink tube can be adjusted. In addition, manufacturers can add glowing gadgets into the empty space of the inner tube. The reception end of the glowing gadget is pushed by the end of the ink tube. Therefore, whenever users write with the pen, the ink tube will push the glowing gadget and the gadget will start glowing. That's why the pen will have this special effect.

DETAILED DESCRIPTIONS

The following is a detailed explanation of the sample in each figure:

FIG. 1 is structural diagram for parts of the double-tube water pen. It is the structure of the double-tube water pen when it is taken apart. This structure includes that the decorative liquid 6 placed in the space between inner tube 1 and outer tube 5 after the assembly is finished. Then, the assembly of the double-tube water pen 10 is finished, as the one shown in FIG. 2.

Please refer to FIGS. 1 and 3, FIG. 3 is the cutaway view of the double-tube water pen. Inner tube 1 is an empty space 11 in the protruding block ring 12 of the outer wall. The empty space 11 has two ends; one is free and the other is closed. The closed end can be connected to outer tube 5 and when it is blocked by outer block ring 12, the inner tube 1 will match closely with the entry mouth of outer tube 5. This arrangement will form an empty tube in outer tube 5. Therefore, decorative liquid 6 can be added from the small hole 51 at the bottom and use glue 52 to close the small hole 51. When this is finished, the decorative liquid 6 will fill the outer tube 5. Because decorative liquid is colorful, it can be seen clearly through the outer tube 5. Therefore, the material of outer tube 5 had better be transparent or semi-transparent.

Then, the open mouth of inner tube 1 can be inserted into pen cover 3. Inner tube 1 can contain an ink tube 2. The tip 21 of ink tube can go through the small hole 31 on pen cover 3. Because of ink tube 3, the double-tube water pen 10 can be used for writing. However, to increase the length of ink tube 3, an extended tube 13 can be extended from the close end of inner tube 1. The extended tube 13 can go in outer tube 5. Similarly, when ink tube 3 goes into extended tube 13, it can further go into outer tube 5 together with extended tube 13. In this way, the length of ink tube 3 can increase a lot.

Moreover, to add more special changes to the decorative liquid 6 placed in outer tube 5, manufacturers can add decoration 7 in to the liquid. For example, decoration 7 includes items such as glowing pieces, glowing powder or threads. Decoration 7 can take different forms such as cartoon pictures or marine creatures. Decoration 7 can float in the liquid to give the liquid shining visual effects.

FIG. 4 is the in-motion diagram of the double-tube water pen. Users have to take off pen top 4 and use the ink tube 2 in the double-tube water pen 10 for writing. At this time, decoration 7 in liquid 6 will start to flow and show the floating and sinking effects. Through light reflection, it will have shining effect.

FIG. 5 is another application of the double-tube water pen. The figure shows that two solutions 61 and 62 (such as water and oil), with different weight and color can be added into outer tube 5 in the double-tube water pen 10. When the pen is moving, the solution 61 with less weight will float upward and the one 62 with heavier weight will go downward. Through different colors, the double-tube water pen will have special visual effect.

Moreover, manufacturers can add a piece of flow-control board 54 inside of outer tube 5. This board will least have one hole 541 and this hole has the function of control the liquid flow. It can help the liquid 61 with less weight to go through hole 541 and gradually go upward and liquid 62 with heavier weight will go through hole 541 and gradually go down. This hole will create a great effect in exchanging liquid. In this application figure, the flow-control board is slanted and there are two holes 541 on the board. The hole 541 on the top is for liquid 61, the lighter one to go in and the other hole 541 at the bottom is for liquid 62, the heavier one to come out.

FIG. 6 is the vertical view of the double-tube water pen with glowing gadget. A glowing gadget 8 can be installed in the empty space 11 in the inner tube. One end of the glowing gadget 8 has a glowing part 81 and it is extended to the closed end or extended tube 13. The other end is the reception end. When ink tube 2 pushes the end, it will make the glowing part 81 of gadget 8 glow. If the users do not want the ink tube 2 to push gadget 8 and make the gadget glow during writing, the users can insert a positioned top 91 at the open mouth of inner tube 1. Then, a metal block 92 can be added between gadget 8 and positioned top 91. Moreover, an expandable spring 93 can be installed between gadget 8 and metal block 92. Then end of ink tube 2 can go through the positioned top 91 and get contact with block 92.

About the structure of glowing gadget 8, it is shown in FIGS. 7 and 8. FIG. 7 is the structural assembly diagram of the glowing gadget and FIG. 8 is the cutaway view of the glowing gadget when it is not glowing. Glowing gadget 8 is made of a glowing part 81, a glowing stand 82, a battery stand 83 and battery set 84 installed in battery stand 83. The short leg 811 of glowing part 81 goes through the small hole 821 on the glowing stand 82 and contact the positive end of battery set 84. The long leg 812 of the glowing gadget 81, after turning, will go into the side tank 821 on the glowing stand 82 and the side tank 831 on battery set 83. The long leg will contact with spring 93 and spring 93 will contact with metal block 92. The metal block 92, however, will not contact the other end (the negative end) of battery set 84. Thus, glowing part 81 will not glow under this situation.

Please refer to FIG. 9. When ink tube 2 goes up, it will push the metal block 92 to go up, too. The protruding point at the center of block 91 will contact with the negative end on battery set 84. This will result in negative current to go from spring 93 to long leg 812 and give both positive and negative current to glowing part 81 and make it glow. On the contrary, If the ink tube 2 does not go up, the metal block 91 will go done because of the expansion of spring 93. Therefore, it will not contact with battery set 84 and result in only positive current at the glowing part 81. Consequently, the glowing part will not glow.

FIGS. 10 and 11 are the vertical view and in-motion diagram the double-tube water pen with the glowing gadget. When users use double-tube water pens, ink tube 2 will be pushed to go upward and start the glowing gadget 8 to make glowing part 81 to glow. The glow will show through inner tube 1. Together with liquid 6 and decoration 7, the pen will show a mystical and glowing effect.

The glowing gadget used in inner tube 1 is not limited to the gadget 8 mentioned in this innovation. Similar designs are available in the market. All of them are suitable to be used in this innovation. Therefore, all glowing gadgets which are similar or equivalent to the one used in this innovation will be part of the claim.

1. Inner and outer tubes will form a space after connecting. Decorative liquid can be added into this space to add more special effects to this pen,
2. When decorative liquid is water, the glowing pieces or powder will create an effect of floating along with the water movement. If the decorative liquid contain both water and oil, through different weights and colors, floating and dripping effects will show.
3. Install a glowing gadget inside of the inner tube. This glowing gadget will be pushed when the pen is in use. The pushing effect will cause the glowing part to glow and add more special effect to the pen.

Figure 1:
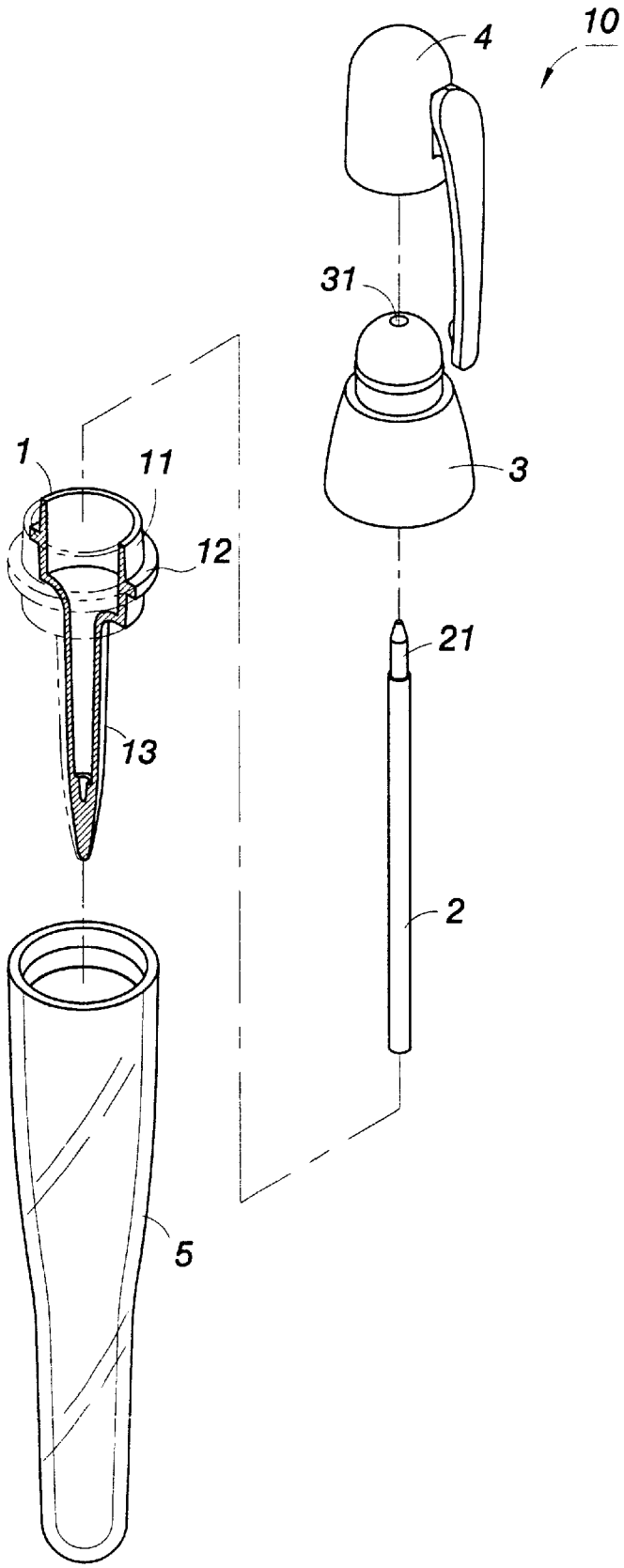
FIG. 1: Structural diagram of the double-tube water pen.
Figure 2:
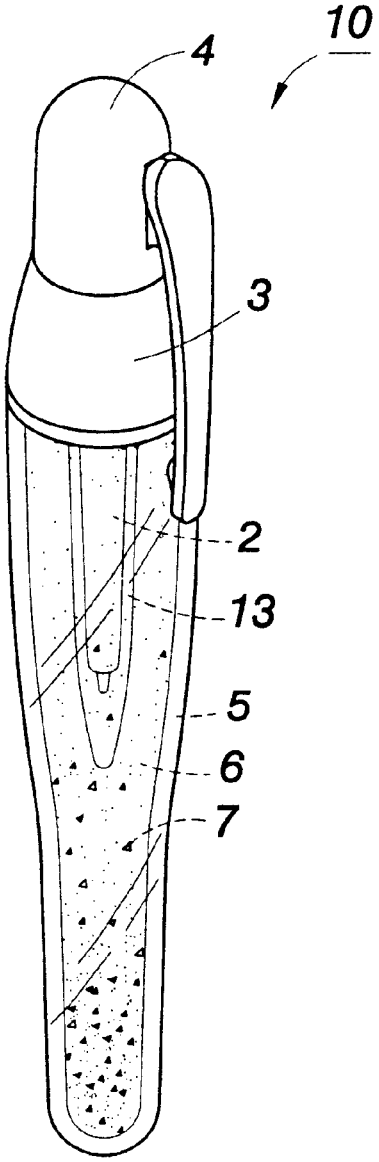
FIG. 2: Structural assembly diagram of the double-tube water pen.
Figure 3:
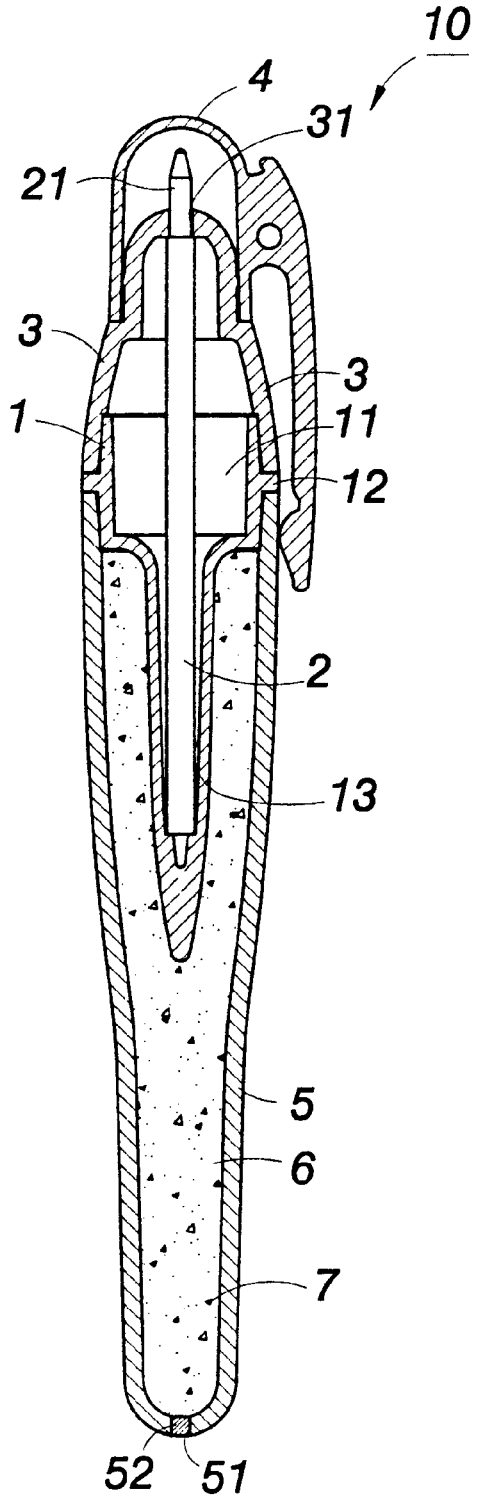
FIG. 3: Cutaway view of the double-tube water pen.
Figure 4:
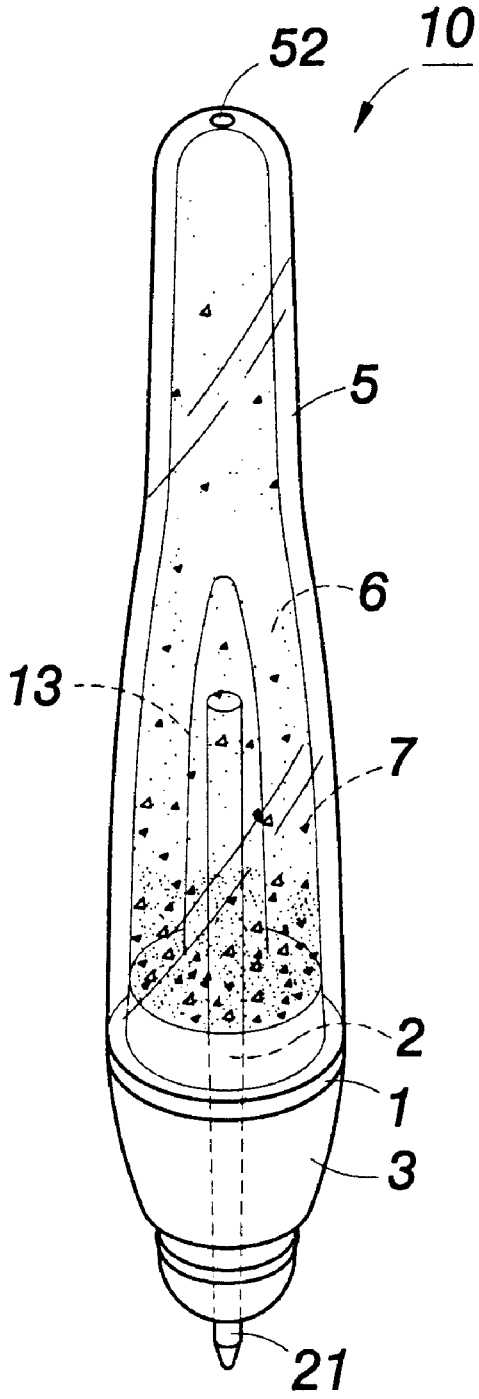
FIG. 4: In-motion diagram of the double-tube water pen.
Figure 5:
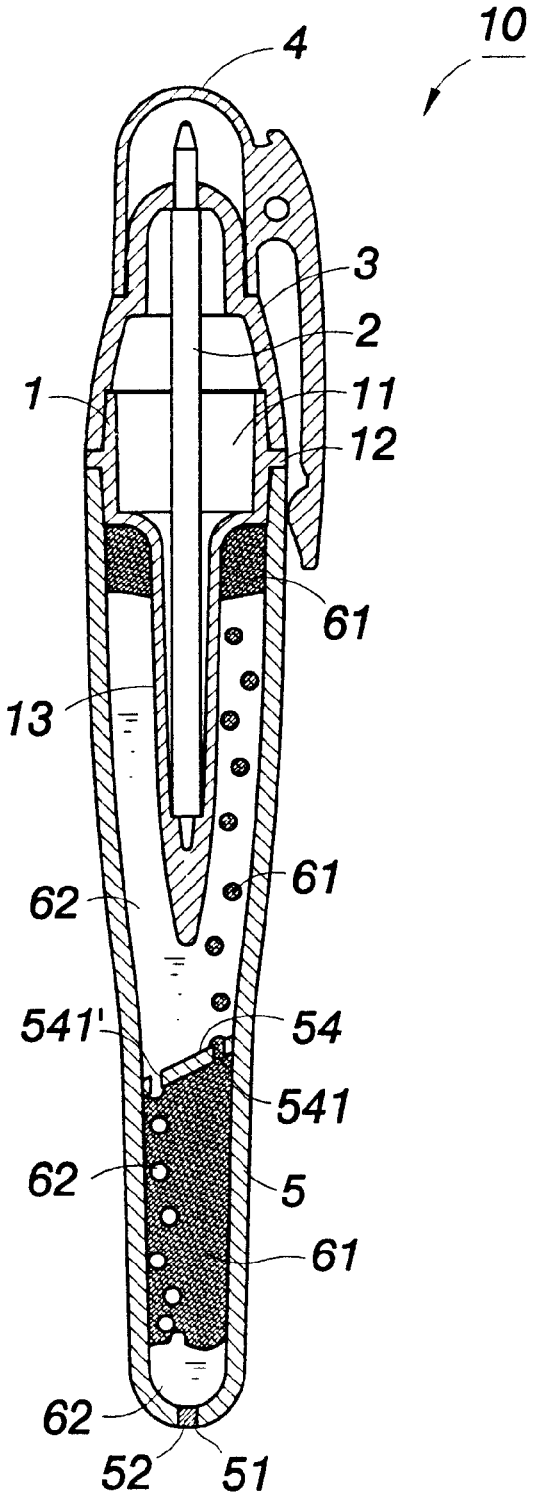
FIG. 5: Another application of the double-tube water pen.
Figure 6:
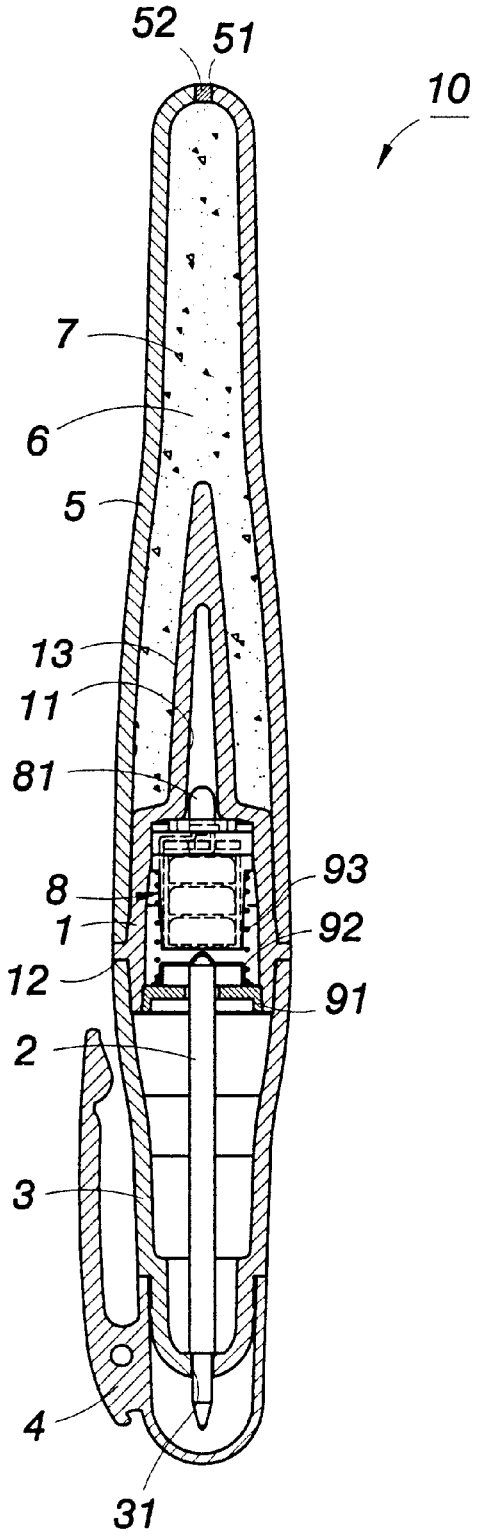
FIG. 6: Vertical view of the double-tube water pen with glowing gadget.
Figure 7:
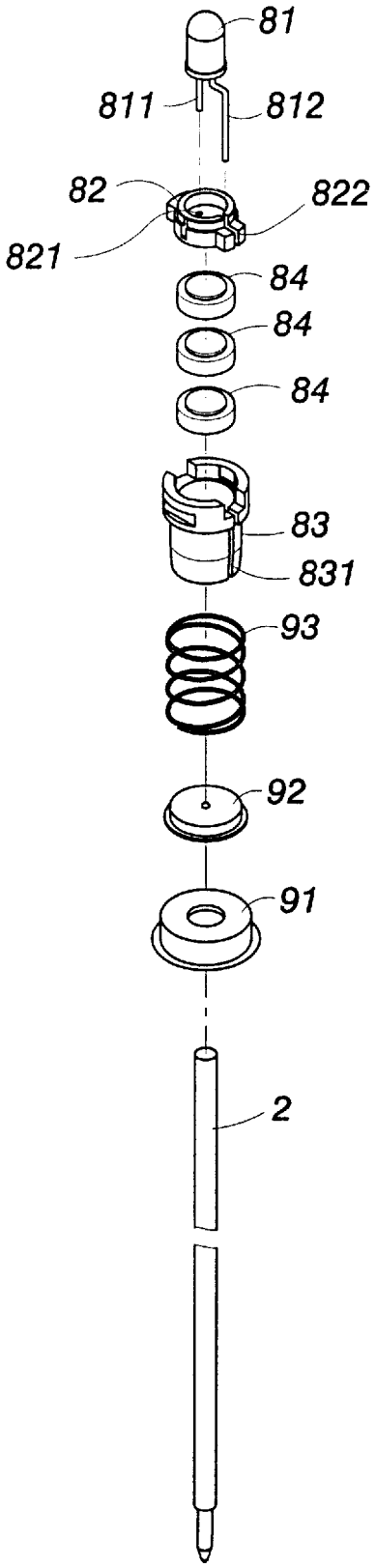
FIG. 7: Structural assembly diagram of the glowing gadget.
Figure 8:
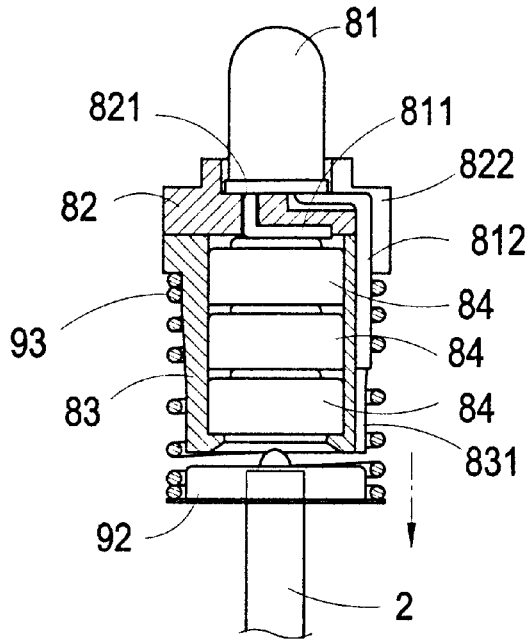
FIG. 8: Cutaway view of the glowing gadget when it is not glowing.
Figure 9:
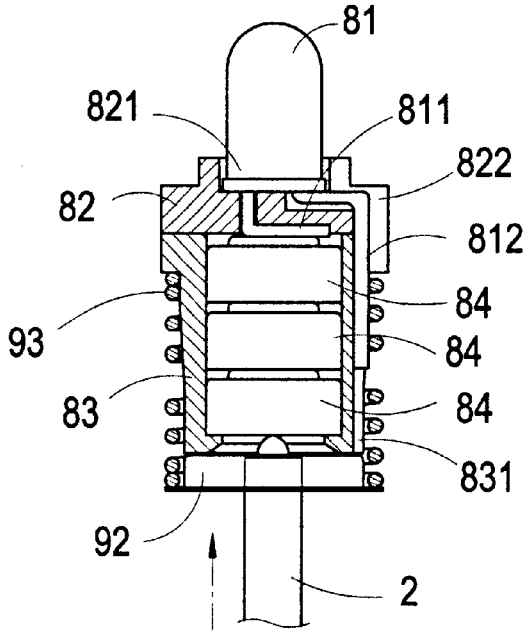
FIG. 9: Cutaway view of the glowing gadget when is glowing.
Figure 10:
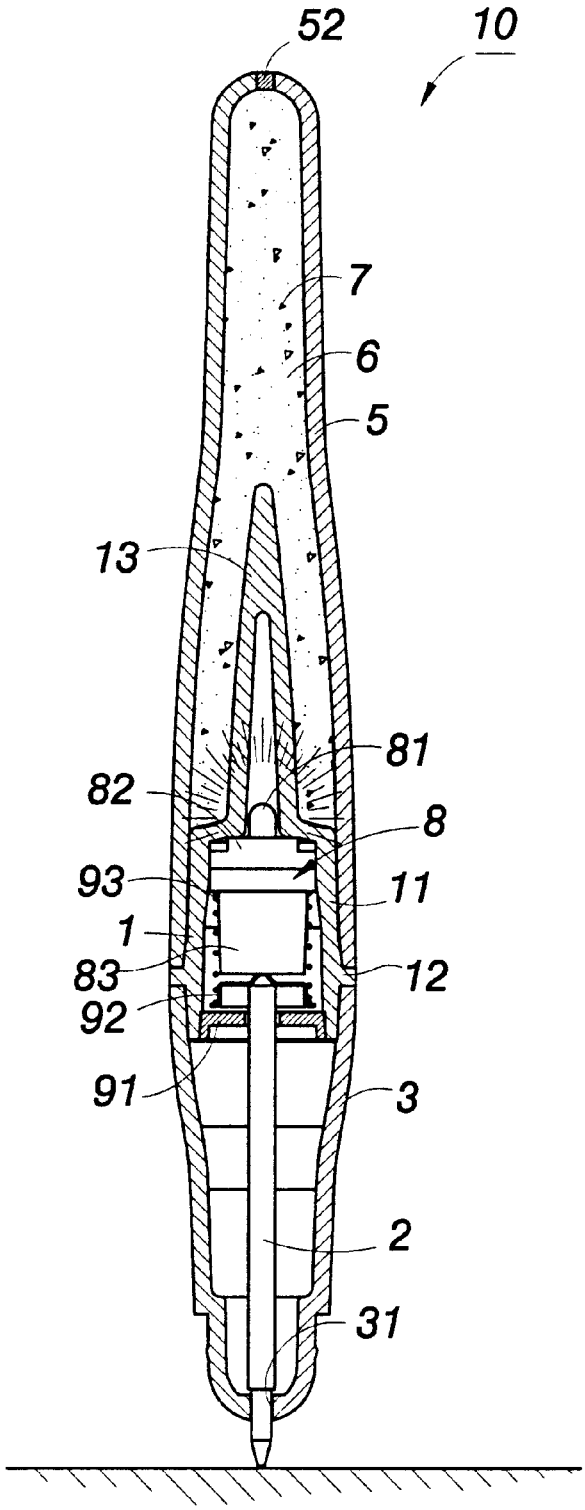
FIG. 10: Vertical view of the double-tube water pen with the glowing gadget.
Figure 11:
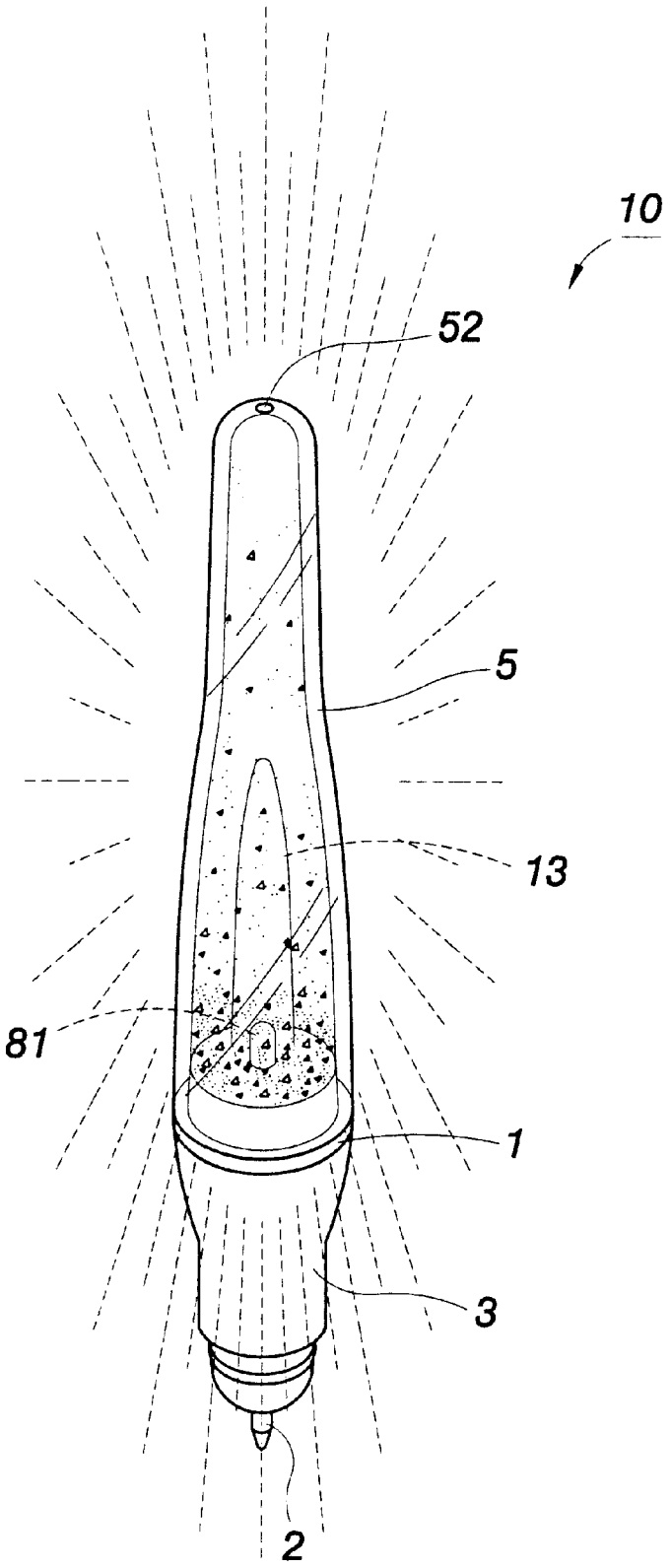
FIG. 11: In-motion diagram the double-tube water pen with the glowing gadget.

What is claimed is:

1. A double-tube water pen comprising:

an outer tube;

a transparent inner tube having an open end and a closed end, said inner tube having an outer wall formed with a protruding block ring, said inner tube being fitted into said outer tube with said protruding block ring on a top of said outer tube;

an ink tube fitted in said inner tube;

decorative liquid filled between said outer tube and said inner tube;

a pen cover configured to engage with the open end of said inner tube;

a pen top engageable with a top of said pen cover; and a glowing gadget installed within said inner tube, said glowing gadget including a glowing part, a glowing stand, a battery stand and battery set installed in said battery stand, said glowing part having a short leg going through a small hole on said glowing stand and contacting a positive end of said battery set, said glowing part having a long leg going into a side tank on said glowing stand and a side tank on said battery set, said long leg contacting a spring which will contact with a metal block, said metal block being disposed on a top of said ink tube.

* * * * *